US005608998A

United States Patent [19]

Hume

[11] Patent Number: 5,608,998

[45] Date of Patent: Mar. 11, 1997

[54] PANEL FOR LINING MANHOLES AND THE LIKE

[76] Inventor: James M. Hume, 2555 CR 13A, S. Elkton, Fla. 32033

[21] Appl. No.: 400,900

[22] Filed: Mar. 8, 1995

[51] Int. Cl.[6] ..... E04B 2/08; E04G 11/04

[52] U.S. Cl. ..... 52/245; 52/20; 52/100; 52/514.5; 52/588.1; 52/592.1; 52/592.2; 52/592.3; 52/592.6; 405/150.1; 405/300

[58] Field of Search ..... 52/245, 20, 592.1, 52/592.6, 514, 514.5, 588.1, 745.08, 100, 592.3; 405/150.1, 300

[56] References Cited

U.S. PATENT DOCUMENTS

| | | | |
|---|---|---|---|
| 791,149 | 5/1905 | Hellyer | 52/245 |
| 2,148,783 | 2/1939 | Spaulding | 405/150.1 X |
| 3,304,954 | 2/1967 | Kaiser | 405/150.1 X |
| 4,089,139 | 5/1978 | Moffa et al. | 52/245 X |
| 4,177,614 | 12/1979 | Arp | 52/169.7 X |

*Primary Examiner*—Christopher T. Kent

*Attorney, Agent, or Firm*—Robert C. Curfiss; Butler & Binion, L.L.P.

[57] ABSTRACT

This invention relates generally to the field of repair for manholes and other like tubular structures and is more specifically directed to a sectioned panel assembly which is premanufactured for installation within an existing manhole.

3 Claims, 2 Drawing Sheets

FIG. 1
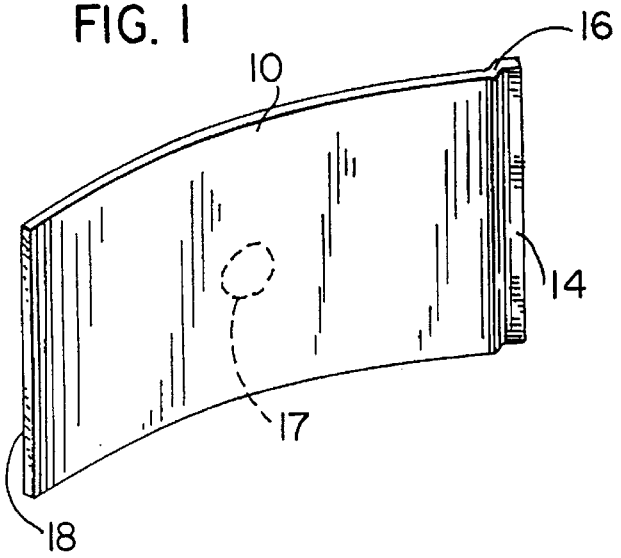
FIG. 3
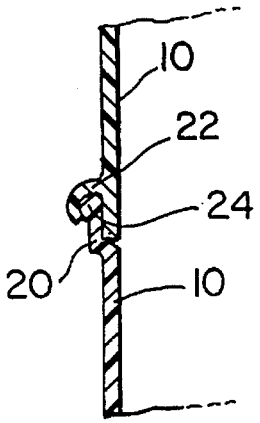
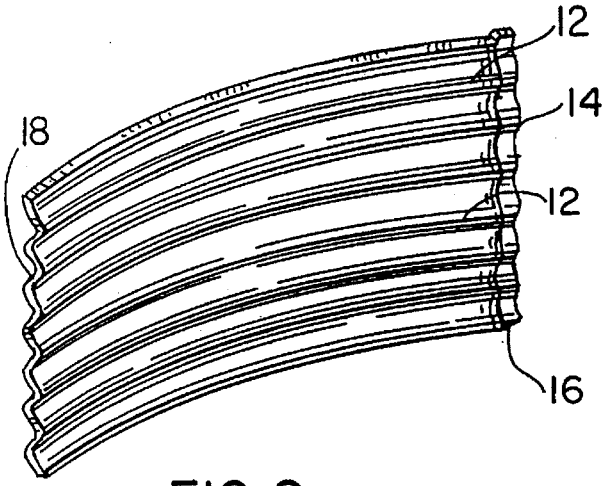
FIG. 2
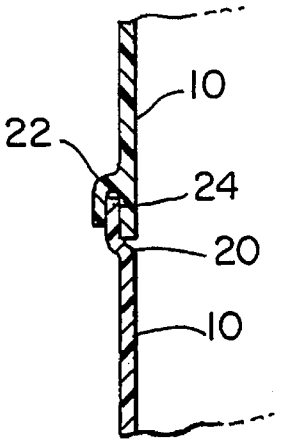
FIG. 5
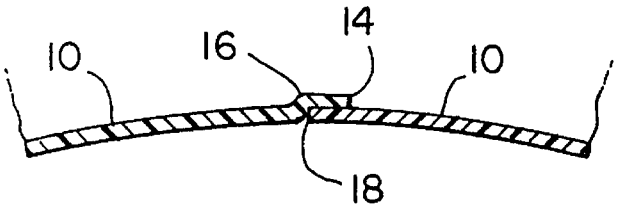
FIG. 4

PANEL FOR LINING MANHOLES AND THE LIKE

BACKGROUND

1. Field of Invention

This invention relates generally to the field of methods and apparatus for the repair of existing manholes and other like tubular structures and is more specifically directed to methods and apparatus involving sectioned panel assemblies and fillers of polymer based materials which can be pre-manufactured for installation within an existing manhole.

2. Description of the Prior Art

Deterioration of waste water system components is a severe and growing problem. Originally built of brick, block or concrete construction, these components develop leaks, cracks and holes due to age, erosion, corrosion and ground water intrusion. Leakage from old manholes and sewer lines contaminates the environment and sometimes result in catastrophic damage with respect to clean-up and repair costs. Over the course of time, settling or shifting of the earth around the manhole and/or the corrosive effects of harsh elements such as acids, alkalis and salts in the sewer or waste water cause degradation of the manholes, resulting in leakage or failure of the integrity of the manhole wall such that the sewage or waste water leaks into the environment. Repair or replacement of defective manholes is a constant problem facing government and private entities.

Since the cost of repairing the components is typically much less than the cost of replacement, many techniques have been developed to repair and rehabilitate waste water system components. For example, it is known to recast manholes and the like through the use of forms and poured concrete, such a shown in U.S. Pat. No. 5,032,197 to Trimble. Because this process is very labor intensive, many techniques are directed toward spray-applied liners. For example, Strong in U.S. Pat. No. 5,002,438 teaches the use of sprayed cement to form a liner inside the deteriorating structure. Spray-applied epoxy, acrylic or polyurethane liners are also known, as is the use of resin impregnated substrates, such as felt, as taught in U.S. Pat. No. 5,017,258 to Brown et al. The current spray-applied systems suffer from moisture, delamination, shrinkage and structural weakness problems resulting from the typical environment encountered in the repair operations. See also my pending application Ser. No. 08/126,376 filed on Sep. 24, 1993, which discloses a technique and device for rehabilitating or repairing waste water system components or the like, comprising a spray-applied, multilayer liner which seals the components and imparts structural integrity. The liner comprises a primer layer, a first moisture barrier layer, a foam layer and a second moisture barrier layer. The primer layer can be applied to wet surface and is the bonding layer between the waste waster system component, typically, a concrete or cement surface, and the first moisture barrier layer imparts structural strength and rigidity to the cured liner. Except for the primer layer, the layers of the liner are all rapid cure materials. Preferably, the primer layer is an epoxy, the moisture barrier layers are polyureas and isocynate blend, and the foam layer a polyurethane.

In addition, a number of solutions have been presented which involve the insertion or creation of liners into the manhole, the new liner providing the integrity to prevent loss of sewer or waste water to the environment. Such solutions in the past have dealt with directly applying a polymer resin, such as a polyester, epoxide, polyurethane or acrylic, to the inner wall of the manhole by troweling, brushing or spraying. This solution provides for a liner which has little structural or reinforcing strength. Another solution is to provide a continuously extruded tubular polymer lining. This solution is difficult to apply to manholes, being primarily directed at the horizontal conduit pipes, and likewise provides little structural and reinforcing attributes.

Another approach is to use a plural number of relatively rigid plastic sheets joined together to form a liner tube within the manhole. For example, U.S. Pat. No. 4,751,799 to Ditcher et al. This construction does not import any structural strength and the joints are susceptible to failure over time. U.S. Pat. No. 4,670,315 to Hillemeier et al discloses a concrete bonding layer placed between the liner and the manhole wall. Other known methods provide for anchoring members which extend into the concrete bonding layer and snap fit members at the joints between the panels, such as U.S. Pat. No. 5,168,682 to Rye. The use of concrete as a bonding layer, because of its significant weight, usually requires that a mandrel or form be used inside the plastic liner until the concrete hardens, since the plastic liner would have to be inappropriately thick to provide enough support on its own when the concrete is poured. Additionally, the use of concrete as the bonding layer means that all incoming water leaks into the manhole being repaired must be completely stopped prior to insertion of the concrete. This is a very labor and time intensive project, as each leak must be individually addressed, and in many cases the leaks are extremely difficult to control.

SUMMARY OF THE INVENTION

The subject invention provides a liner system that not only lines the manhole to prevent leaks and separate the corrosive components from the manhole materials, but also provides independent structural integrity and reinforcement capability, such that the liner will have a long life and further that the combination of the liner with the manhole will result in a combination manhole structure having the same or better strength and integrity as compared to the original manhole structure in its deteriorated state. The subject invention provides for a method and apparatus to repair manholes by providing a liner composed of a number of preformed panels and a bonding layer to join the liner to the manhole wall, where no forms or mandrels are required during construction, where mechanical fasteners or snap-fit members are not required to join the panels, where the bonding layer is a polymer foam material which is applicable without the necessity of stopping incoming liquid leaks prior to injection, and where the bonding layer provides structural integrity, strength and reinforcement to the manhole without excessive weight problems and without the necessity for anchoring projections, which can cause voids in the filler material. The preferred embodiment also includes the means and method for sealing the upper opening for minimizing the loss of gases through the standard manhole cover.

Specifically, the invention is an apparatus for and the method of applying the apparatus for the repair of existing manholes in sewer or waste water systems, the invention comprising formation of a number of arcuate rigid or semi-rigid plastic panels, preferably corrugated, which are joined laterally by the use of adhesive to form an annular tube of short vertical height, each panel and successive annular tube being supported by a lower panel and annular tube, wherein the upper panels and tube have a receiving channel or lip which rests on the upper edge of the lower panels and tube. After constructing and joining enough tubes to create a liner with the desired vertical height to fill the manhole, a polymer foam material is injected between the liner and the manhole wall, either from the top or through injection ports provided in the panels themselves. This polymer bonding material acts to seal the system by permanently joining the panels and tubes to each other, as well as bonding the liner to the manhole wall to provide structural strength and reinforcement to the overall combined system.

In the preferred embodiment, the invention may include a gas seal which is positioned at the top opening of the liner. Specifically, in one embodiment, a short tubular lid includes an outwardly extending upper lip which rests on the interior shoulder of the manhole cover seating ring, which is embedded in the polymer foam bonding material. An inwardly extending lower lip supports a generally circular removable lid. The circular lid prevents gases from escaping through the manhole cover from the interior of the liner and the weight of the metal cover pressing the upper lip against the seating ring prevents loss of gases around the lid receiving member.

BRIEF DESCRIPTION OF THE DRAWINGS

FIG. 1 is a view of the internal side of a noncorrugated panel.

FIG. 2 is a view of the internal side of a corrugated panel.

FIG. 3 is a fragmentary section view of an assembled liner showing a number of panels joined between top and bottom edges.

FIG. 4 is a fragmentary section view of the liner showing panels joined end to end.

FIG. 5 is a sectional view similar to FIG. 3, showing an alternative embodiment.

DETAILED DESCRIPTION OF THE DRAWINGS

Figure 6:
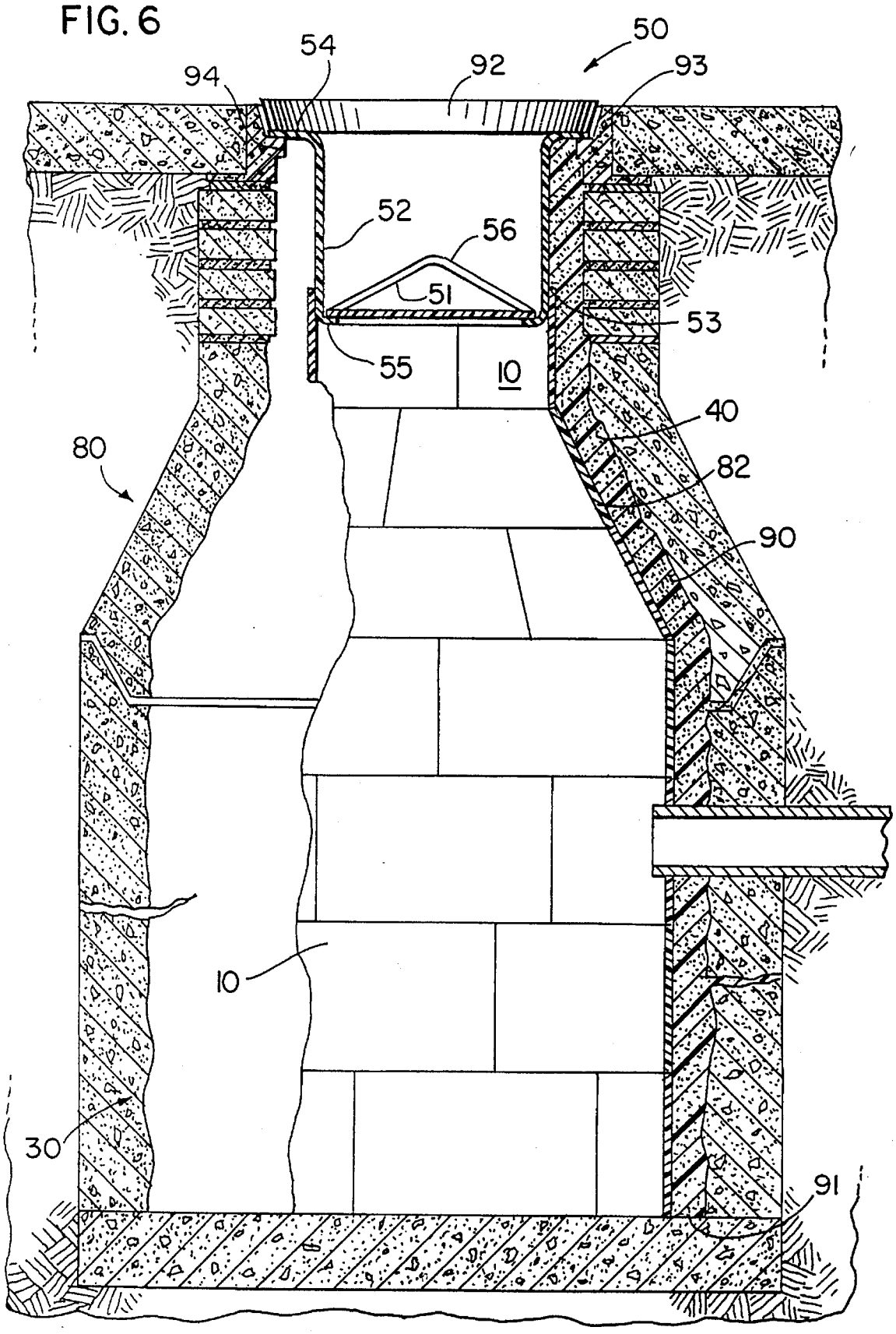
FIG. 6 is a sectional view of a manhole with an installed liner and a gas seal mechanism at the top of an installed liner.

The invention will now be described in detail as to best mode and preferred embodiments with reference to the drawings. The invention comprises both an apparatus for repairing existing manhole structures and the like, as well as the method of effecting this repair using the apparatus. The invention is suited for repair of vertical, generally tubular structures which can benefit from insertion of a liquid and gas impermeable liner which prevents leakage of liquid or gas through the manhole structure into the environment, and which can further benefit from a liner and bonding material assembly which strengthens and reinforces the original manhole structure. The invention is particularly suited for application to manholes constructed from brick or block and mortar, or from concrete either pre-formed or formed in situ, where the internal surface of the damaged or degraded manhole is uneven and irregular.

As shown in FIG. 1, the panels generally comprise a substantially rectangular sheet 10 of arcuate crosssection. Each panel may be of a generally flat surface as shown in FIG. 1 or may be corrugated with ribs 12, as shown in FIG. 2. Typically, the panels are semi-rigid and, when assembled form a closed arc corresponding generally to the circumference of the manhole, the panel assembly being sufficiently flexible to adjust to the variations in size and the typical irregularities of construction of the original manhole.

In the preferred embodiment, each panel is formed by extrusion or injection molding, or vacuum forming and is composed of a relative firm, light weight, strong polymer resistant to corrosive liquids and gases, such as polyvinyl chloride (PVC) or the like. As best seen in FIGS. 1 and 2, one end 14 of each panel includes an integral L-shaped channel 16 which is adapted to receive the unaltered opposite end 18 of an adjacent like panel in the assembly, see FIGS. 4 and 6. It is important that the end 18 be unaltered. This permits the panel assembly to be cut to fit a specific manhole perimeter without special forming tools, accommodating the L-channel 16 of the opposite end in the standard manner regardless of the length of the last panel in each annular or tubular section of the assembly.

As best seen in FIG. 3 and 5, it is desirable to provide a similar, substantially L-shaped channel 20 along the top edge of each panel and a U-shaped receptive channel 22 along the bottom edge. This permits stacking of the tubular sections within the manhole to form a vertical liner as shown in FIG. 6. In the embodiment of FIG. 3, the lip 24 of channel 20 is enlarged to form a snap-fit with the U-channel 22, providing a snap together assembly. In FIG. 5, a straight lip 24 is provided, allowing the lip to slide into the U-channel.

Typically, the various abutting panels are glued or otherwise adhesively bonded together at each overlapping joint, formed either by end walls 14 and 18 or by top and bottom edges 20 and 22. However, where the beaded lip 24 is used, glue or other bonding agents may be eliminated between stacked sections, the snap fit construction being sufficient to hold the assembly in place during installation and bonding.

As shown, each panel 10 is slightly curve or arcuate, having an internal concave side and external convex side, such that when a number of panels 10 are joined laterally, an annular tubular section will be formed. Panel members 10 do not need to be of any particular size or thickness, but a panel 10 having dimensions of approximately one foot in height, approximately three feet in length and approximately one-eighth inch in thickness has been found to be suitable and preferred in application. Preferably, the receiving channel 22 extends internally from the panel 10, that is, from the concave side. Receiving channel 24 is sized to receive the upper edge or lip 22 of another panel 10, such that one panel 10 will be vertically supported by another lower panel 10, and one tubular section will be vertically supported by a lower tubular section, as shown in FIG. 6. Upper edge 20 preferably is positioned slightly to the internal, or concave, side of panel 10. Likewise, lap channel 16, is also positioned slightly to the internal side of panel 10. The lap channel 16 of one panel 10 is joined to the adjacent lateral panel 10 again preferably by adhesive.

In this manner, when a number of panels 10 are joined to form a tubular section, and successive tubular sections are mounted upon each other, the external side of the resulting liner will be relatively smooth, with no protuberances or structures to create voids when bonding material is injected between the liner and the manhole wall as shown in FIG. 6.

In an alternative embodiment of the invention, panel members 10 can be formed with corrugated profile, as shown in FIG. 2, rather than the straight profile shown in FIG. 1. The presence of corrugations or ribs 12 supply added structural integrity to assembled liner, which can be particularly useful when repairing manholes with larger diameters. It is preferred that the corrugations 12 in each panel 10 be limited in depth and number so as not to cause void formation when the bonding material 40 is injected. For example, in a panel 10 with a height of one foot, a maximum of four corrugated ribs 12 with a maximum depth of one inch is preferred.

In another alternative embodiment, panel members 10 may also comprise injection ports 17, a shown in FIG. 1, which allow bonding material to be injected through any given panel 10 as well as from the top of the tubular structure (see FIG. 6). It is preferred that injection port 17 be kept simple for case of formation of the panels 10, and may for example comprise a weakened or inscribed point in the body of the panel 10 which can be forcefully broken by the nozzle for applying the bonding material. The injection port 17 is completely and permanently sealed by bonding material when injected.

The polymeric foam bonding material 40 injected between the liner 30 and the manhole wall 90, as shown in FIG. 6 is composed of a material which will expand to fill the gap 91, seal any openings in the liner 30 or in the manhole wall 90, permanently join the panels 10 and tubular sections to each other to create an integral liner 30, which is impermeable to liquid or gas, bond the plastic liner 30 directly to the manhole wall 90 by adhering to both, and cure to form a semi-rigid filler body which has a small amount of flexibility, compressibility and elasticity. Because the bonding material 40 is semi-rigid with the above described properties, it provides a much durable bond between the manhole wall 90 and the liner 30 as opposed to fully rigid concrete. Concrete can only respond to positional changes by either cracking or separation from either the liner 30 or the manhole wall 90, resulting in eventual failure of the repairs.

A polyurethane foam is suitable for bonding material 40, as the cured foam is impermeable to liquids and gases, corrosive resistant, expands to fill any holes, crevices or irregularities in the manhole wall 90 and, most importantly, can be applied even if water is present on the manhole wall 90. This is most preferable during installation in that any existing, active leaks do not need to be stopped prior to injection of the bonding material 40.

The method of the invention comprises the steps of providing the panels 10, joining a number of panels 10 laterally to form a tubular section with a diameter just slightly smaller than that of the manhole 90 to be repaired, the joining occurring preferably in situ, forming successive tubular sections on top of the previously constructed tubular section until the desired height for the liner is reached, and injecting the polymeric foam bonding material 40 between the liner 30 and manhole wall 90, either as each tubular section is completed or at the end when the full liner has been assembled, and either from the top or through injection ports 17, or both. The panels 10 are preferably joined laterally using adhesively joined lap channel members 16 and joined vertically using adhesive joined receiving channels 22 and upper edges 20, or snap fit lips, as desired. The use of the polymeric foam as the bonding material 40 means that incoming water leaks in the manhole wall 90 do not need to stopped, as the polymeric foam will expand and cure rapidly, sealing the leaks as it is injected.

The apparatus may also include a gas seal mechanism 50, as shown in FIG. 6. In the preferred embodiment, the gas seal 50 includes a circular lid 51 and tubular lid receiving member 52 adapted to fit within the manhole cover seating ring 93. The gas seal 50 is positioned at the top 53 of liner 30 and is designed to prevent the escape of gases into the atmosphere from within the interior of the liner 30. The lid receiving member 52 has an outwardly extending upper flange or lip 54 and an inwardly extending lower flange or lid 55. The upper flange 54 seats onto the interior shoulder 94 of the original seating ring 93 and the original manhole cover 92 sits on top of the upper lip 53. The manhole cover seating ring 93 is embedded into the polymeric foam bonding material 40 during assembly. The circular lid 51 fits internally within the lid receiving member 52 and rests on the lower lip 55. Lid 51 may have a handle 56 attached to it for ease of removal. In use the lid 51 prevents the escape of gases from the interior of liner 30, while the upper lip 55 and the bonding material adjacent the seating ring 93 prevent the escape of gases from around the lid receiving member 52. These components can be made of any suitable material, such as for example PVC.

As shown in FIG. 6, where the manhole includes tapered or truncated conical sections 80, the panels may be formed as truncated conical sections 82 to accommodate the taper.

It is understood that obvious equivalents and substitutions for elements of the above described invention may be apparent to those skilled in the art. The above examples are by way of illustration only, and the true scope and definition of the invention is to be as set forth in the following claims.

What is claimed is:

1. A panel for building a liner for lining a manhole in situ, said panel comprising:

a substantially rectangular plate having opposite ends, an upper edge, a lower edge, a concave arcuate cross-section and corrugated ribs, said ribs running parallel to said upper and lower edges of said panel, said lower edge having a U-shaped channel, said upper edge having a lip with an enlarged portion adapted to be snap-fit into said U-shaped channel; and one of said opposite ends of said panel including a lap channel for receiving the other of said opposite ends of said panel; whereby a plurality of said panels may be stacked in an upper edge to lower edge relationship and may be placed in an opposite end to opposite end relationship to form an annular tubular member of predetermined height.

2. The panel of claim 1, further including a porthole through which material may be injected.

3. The panel of claim 1, further including an area in said panel which is weakened and may be forcibly removed from the panel to form a porthole through which material may be injected.

* * * * *